US007344487B2

(12) United States Patent
Carter et al.

(10) Patent No.: US 7,344,487 B2
(45) Date of Patent: Mar. 18, 2008

(54) EXERCISE SYSTEM

(75) Inventors: Kevin Dwayne Carter, Pasadena, CA (US); Robert Anthony Centrone, Pasadena, CA (US)

(73) Assignee: Blue Light Design, Inc., South Pasadena, CA (US)

( * ) Notice: Subject to any disclaimer, the term of this patent is extended or adjusted under 35 U.S.C. 154(b) by 0 days.

(21) Appl. No.: 11/228,057

(22) Filed: Sep. 16, 2005

(65) Prior Publication Data

US 2007/0066461 A1 Mar. 22, 2007

(51) Int. Cl.
*A63B 26/00* (2006.01)

(52) U.S. Cl. ..... 482/142

(58) Field of Classification Search ..... 482/140, 482/142, 148, 91; D21/662, 398; 446/220
See application file for complete search history.

(56) References Cited

U.S. PATENT DOCUMENTS

| | | | | | |
|---|---|---|---|---|---|
| 3,517,933 | A | * | 6/1970 | Malkin | 473/125 |
| 4,088,319 | A | * | 5/1978 | Clarke | 473/575 |
| 4,192,094 | A | * | 3/1980 | Johnson | 446/458 |
| 4,291,487 | A | * | 9/1981 | Magid | 446/186 |
| 4,609,196 | A | * | 9/1986 | Bozinovic | 473/594 |
| 5,102,364 | A | * | 4/1992 | Kubiatowicz | 446/220 |
| 5,102,365 | A | * | 4/1992 | Wang | 446/221 |
| 5,253,866 | A | * | 10/1993 | Moorman et al. | 473/571 |
| D387,805 | S | * | 12/1997 | Hsu | D19/61 |
| 5,735,776 | A | | 4/1998 | Swezey et al. | 482/91 |
| 5,810,700 | A | | 9/1998 | Orcutt | 482/123 |
| 5,967,917 | A | * | 10/1999 | Feeney et al. | 473/604 |
| 6,012,997 | A | * | 1/2000 | Mason | 473/594 |
| 6,158,390 | A | * | 12/2000 | Holtier et al. | 119/707 |
| 6,328,675 | B1 | | 12/2001 | Kaye | 482/44 |
| 6,398,616 | B1 | * | 6/2002 | Motosko, III | 446/220 |
| 6,517,471 | B2 | | 2/2003 | Chen | 482/148 |
| 6,537,125 | B1 | * | 3/2003 | Motosko, III | 446/220 |
| 6,547,703 | B1 | | 4/2003 | Swezey et al. | 482/91 |
| 6,652,421 | B1 | * | 11/2003 | Chen | 482/49 |
| 6,699,162 | B2 | | 3/2004 | Chen | 482/140 |
| 6,739,725 | B2 | * | 5/2004 | Ben-Ari | 353/28 |
| D494,233 | S | * | 8/2004 | Kerry | D21/662 |
| D498,799 | S | * | 11/2004 | Kerry | D21/662 |
| 6,835,168 | B2 | | 12/2004 | Huang | 482/123 |
| 6,837,835 | B2 | | 1/2005 | Huang | 482/126 |
| 6,837,836 | B2 | * | 1/2005 | Huang | 482/126 |
| D503,756 | S | * | 4/2005 | Chiang | D21/662 |
| D509,548 | S | * | 9/2005 | Heitzman et al. | D21/662 |
| D521,084 | S | * | 5/2006 | Huang | D21/662 |
| 7,077,553 | B2 | * | 7/2006 | Vanderschuit | 362/565 |
| 7,118,517 | B1 | * | 10/2006 | Hale | 482/140 |
| 7,141,011 | B2 | * | 11/2006 | Williams et al. | 482/148 |
| 2005/0143234 | A1 | * | 6/2005 | Massey | 482/140 |
| 2006/0025291 | A1 | * | 2/2006 | Williams et al. | 482/140 |
| 2006/0229177 | A1 | * | 10/2006 | Hale | 482/140 |
| 2007/0015645 | A1 | * | 1/2007 | Hale | 482/140 |

* cited by examiner

*Primary Examiner*—Lori Amerson
(74) *Attorney, Agent, or Firm*—Niky Economy Syrengelas, Esq.; K. David Crockett, Esq.; Crockett & Crockett

(57) ABSTRACT

An inflatable exercise ball having a bore extending therethrough and a resistance apparatus disposed within the lumen.

12 Claims, 8 Drawing Sheets

EXERCISE SYSTEM

FIELD OF THE INVENTIONS

The inventions described below relate the field of physical training and fitness equipment and more particularly relates to inflatable exercise balls for stretching, exercise and therapy.

BACKGROUND OF THE INVENTIONS

Various types of resilient exercise devices for increasing flexibility, strength and therapy are available. One such device is the exercise ball. Exercise balls are often used for physical conditioning and therapy in the sports, physical fitness and orthopedic fields.

Exercise balls, sometimes called "therapy balls" or "Swiss balls," are flexible balls generally ranging in diameter from approximately 30 cm to 110 cm and may be inflatable or may be filled with a soft foam material to provide the necessary resiliency. Balls of this type are used for a wide range of exercise activities including spinal exercises, exercises for cardiovascular improvement and activities to strengthen the upper and lower extremities. Further, because of the wide range of low impact exercises that can be performed using such balls, exercise balls are also well suited for use by individuals at higher risk of injury during exercise.

Although useful for many purposes, exercise balls are not particularly suited for traditional strength training programs, which typically employ resistance training to stimulate muscle growth or muscle strength. A Swiss ball may be employed during "squeezing" exercises of the arms or legs that do not require the user to rest upon the ball. Consequently, an exercise ball cannot be easily incorporated into strength training regimens without forfeiting the traditional benefits associated with Swiss ball therapy, namely, the development of flexibility, balance, and seldom-used stabilizer muscles.

A "home gym" device enables a user to perform a variety of exercises in the privacy of his or her home. However, such devices can be bulky, difficult to operate, or expensive to purchase, and users of such devices may be limited to only a small number of different exercises. On the other hand, simple and inexpensive home gym devices may not be configured to perform a large number of different exercises. In addition, conventional home gym devices do not combine strength training with the additional benefits associated with exercise ball exercises.

A device is needed that provides both the traditional benefits associated with exercise ball therapy such as the development of flexibility, balance, and seldom-used stabilizer muscles with the added benefits of strength training. The devices and methods disclosed provide both the traditional benefits associated with the exercise ball with the added benefits of strength training.

SUMMARY

An exercise system is disclosed comprising an inflatable exercise ball having a bore extending therethrough and a resistance apparatus. The inflatable exercise ball is configured such that a user can rest a portion of his or her body on the exercise ball while pulling the resistance apparatus in an elongation direction in order to perform various resistance exercises.

DETAILED DESCRIPTION OF THE INVENTIONS

Figure 1:
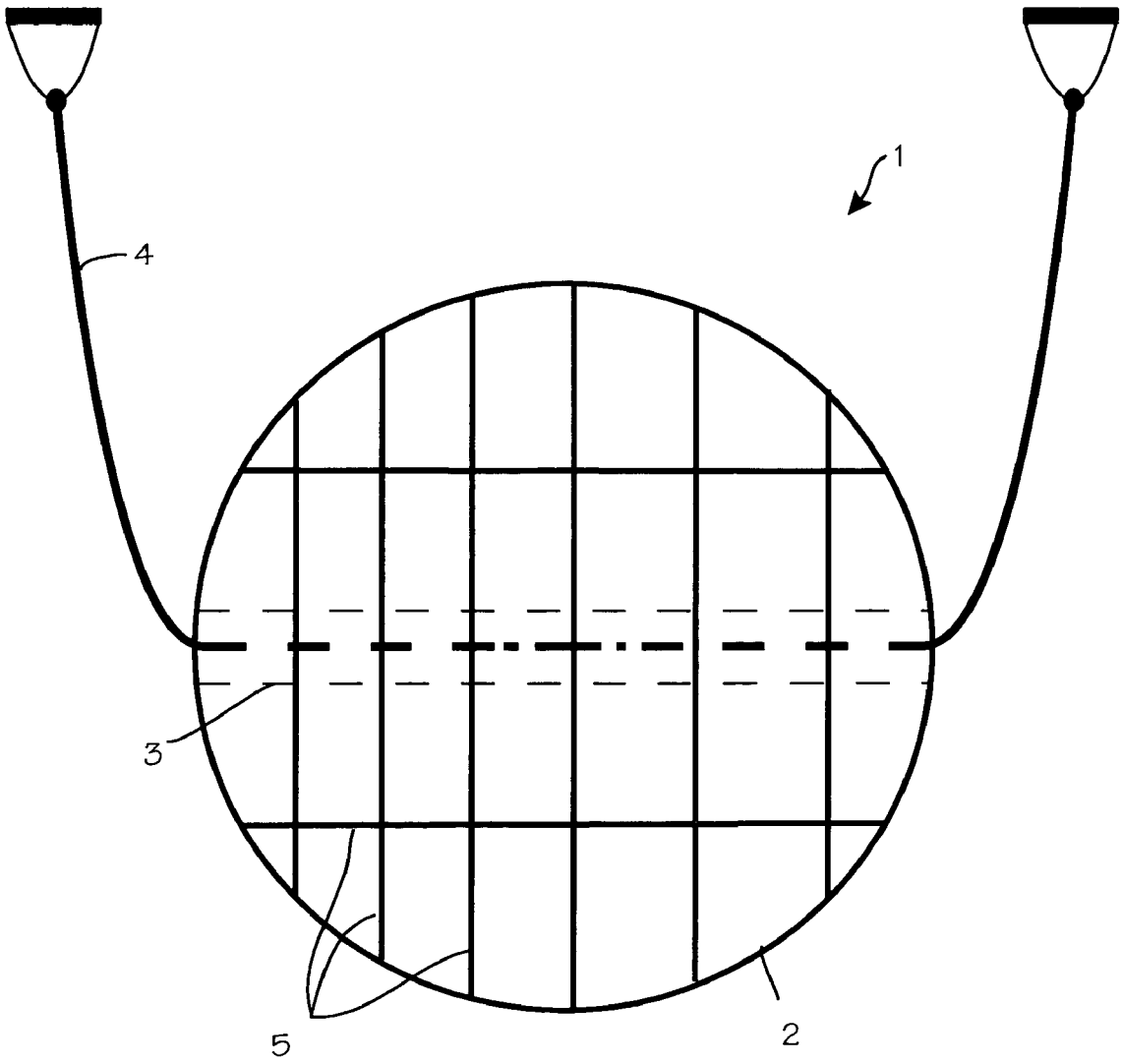
FIG. 1 depicts the exercise system.

FIG. 1 depicts the exercise system 1. The exercise system comprises an inflatable exercise ball 2 having a bore 3 extending therethrough and a resistance apparatus 4. The bore 3 may extend through the ball at any location, but extension of the lumen through approximately the center of the ball 2 is preferred. The inflatable exercise ball is provided with a grip pattern 5 or grid on the exterior of the exercise ball. This pattern comprises a series of ribs extending from the outer surface of the ball 2. The pattern is adapted to prevent the ball from slipping on a surface such as the floor or the body of a user.

The exercise system 1 is configured to enable user to conveniently perform a number of different exercise movements to train a variety of muscle groups as shown in FIGS. 6 through 10. The shape, size, and other physical characteristics of exercise system 1 may vary to suit the needs of the specific application, user, or production limitations. The exercise system 1 is configured to allow a user to rest a portion of his or her body on the exercise ball while pulling the resistance apparatus in an elongation direction.

The inflatable exercise ball 2 is typically spherical in an underformed state. The spherical shape enables a user to manipulate his or her body comfortably upon ball during "rolling" exercises. The exercise system also facilitates the development of balancing and stabilizing muscles during static exercises that may involve resistance training.

Figure 2:
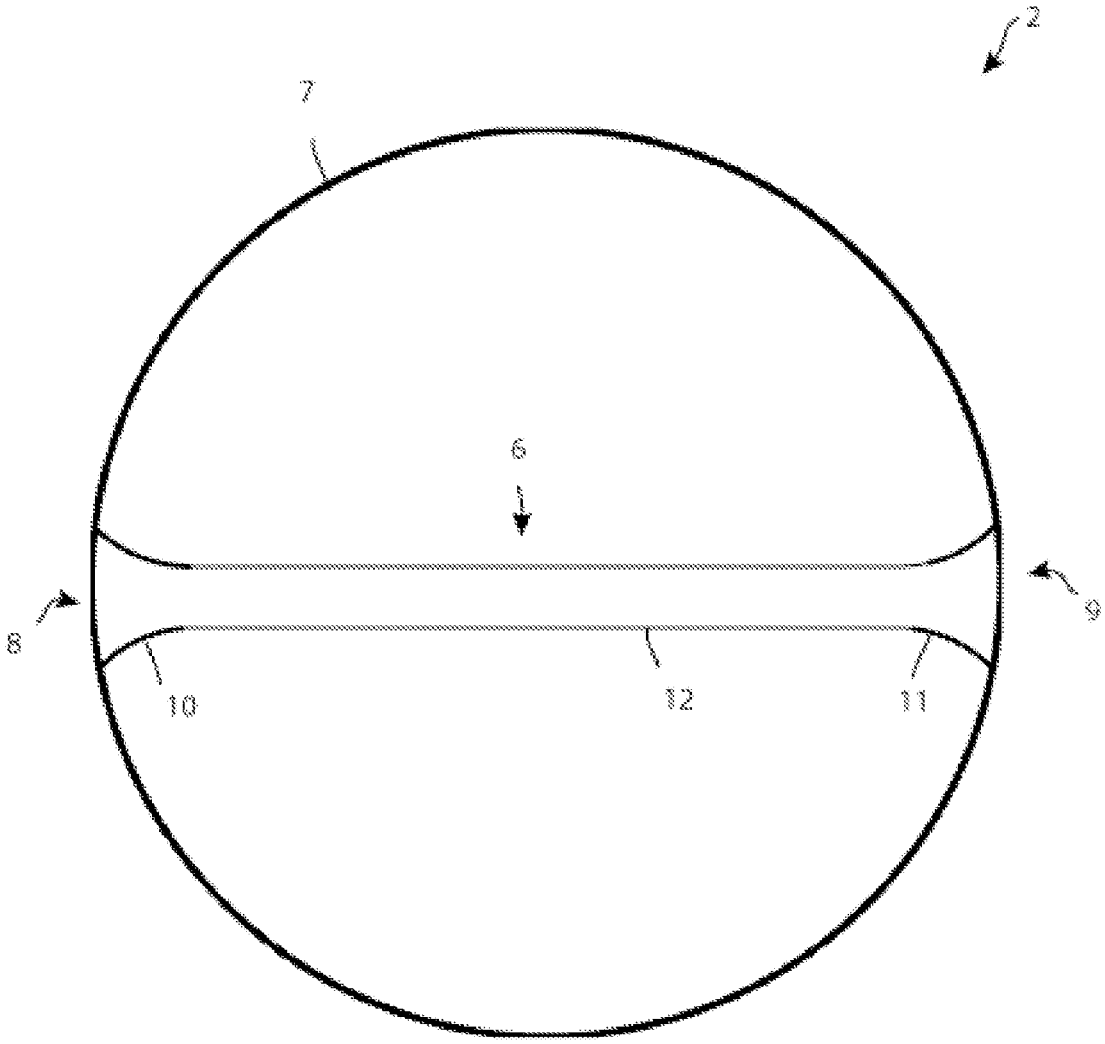
FIG. 2 illustrates a cross-sectional view of the inflatable exercise ball in the exercise system.

FIG. 2 illustrates a cross-sectional view of the inflatable exercise ball 2 of the exercise system. The inflatable exercise ball 2 comprises a polymeric shell 7 adapted to expand when inflated with a fluid such as air to a desirable gas or fluid pressure. Suitable materials for the shell include nylon, polyurethane, PVC or synthetic rubber. The bore 6 comprises a first opening 8, a second opening 9, a first flange fitting 10, a second flange fitting 11 and a tube 12 of resilient material. The material of the tube 12 is selected to prevent collapse or deformation such as ovalization or flattening of the inner diameter of the lumen when the ball is inflated. The material comprising the tube can also be selected to allow the tube to compress longitudinally when a user compresses the ball. The ability of the tube 12 to compress can prevent injury to a user during exercises. In FIG. 2, the cylindrical tube 12 is a flexible pipe comprising an over-molded metallic spring. The inflatable exercise ball 2 may generally range in diameter from approximately 30 cm to 110 cm when inflated. In an alternative embodiment, the exercise system 1 may also comprise a solid ball of resilient material having a bore extending therethrough with a resistance apparatus 4 disposed within the bore 3.

Figure 3A:
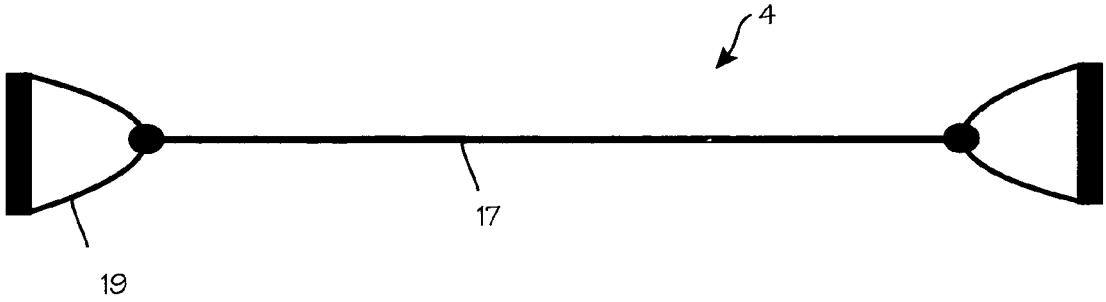
FIG. 3*a* illustrates the resistance training apparatus of the exercise system with two handles.

FIG. 3*a* illustrates the resistance apparatus 4 of the exercise system 1. The resistance apparatus 4 is configured to provide resistance in response to a force applied by user. The resistance apparatus 4 comprises a length of elastomeric tubing 17. Alternatively, the resistance apparatus 4 may comprise a spring element, a plurality of elastic bands, a sheet of elastic ribbon, or any suitable material for generating resistance. The resistance of the resistance apparatus may be selected according to several factors, such as the thickness of a resistance material or a particular composition of an elastomeric material. The resistance apparatus 4 can be provided with metallic or polymeric rings or hooks at each end of the length of elastomeric tubing to facilitate coupling.

As shown in FIG. 3*a*, the resistance apparatus 4 may include one or more handles 19 to enable the user to effectively perform exercises. The resistance apparatus 4 may further be provided with stirrups, collars, belts, or other attachments for engaging various body parts during exercise. These attachments are suitably removable and interchangeable to facilitate different exercises.

Figure 3B:
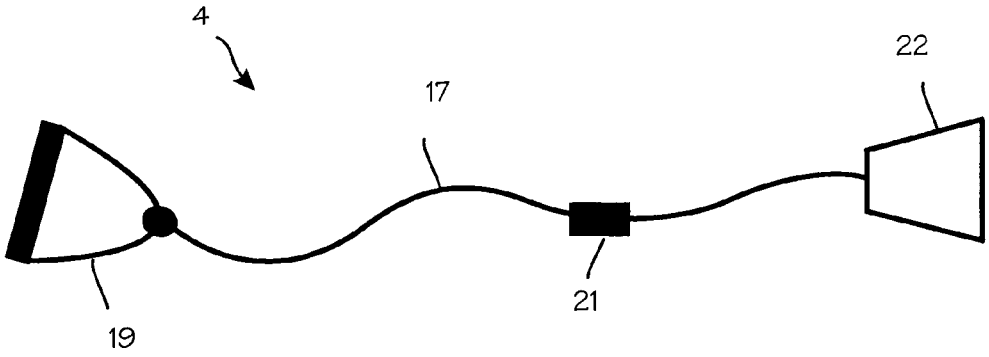
FIG. 3*b* illustrates the resistance training apparatus of the exercise system with a handle and a plug.

The resistance apparatus may include tension adjusters 21 for varying the length and effective tension of the resistance apparatus as shown in FIG. 3*b*. The exercise system is 1 suitably compatible with more than one resistance apparatus 4, either singly or in combination, to facilitate variations of resistances or exercises. A plug 22 may also be coupled to a first end of the elastomeric tubing in the resistance apparatus. The plug 22 is adapted to prevent the elastomeric tubing 17 from being completely pulled through the lumen 3. A second end of the elastomeric tubing 17 may then be coupled to a handle 19, stirrups, collars, belts, or other furnishings for engaging various body parts during exercise. Use of the plug 22 with the resistance apparatus allows a variety of exercises to be performed by a user.

The shell 7 of the exercise ball 2 may be manufactured using rotational molding. Thermoplastics and some thermosets are formed in hollow parts by rotational molding. A mold is made of two pieces and designed to be rotated about two perpendicular axis. Plastic material is placed within the mold. The mold is then heated while being rotated. The rotation forces the plastic onto the inner surfaces of the mold where the plastic material then melts and takes the shape of the mold. In this process, the shell can be manufactured as one piece having a first opening and second opening for placement of the flexible pipe to create the lumen.

Figure 4:
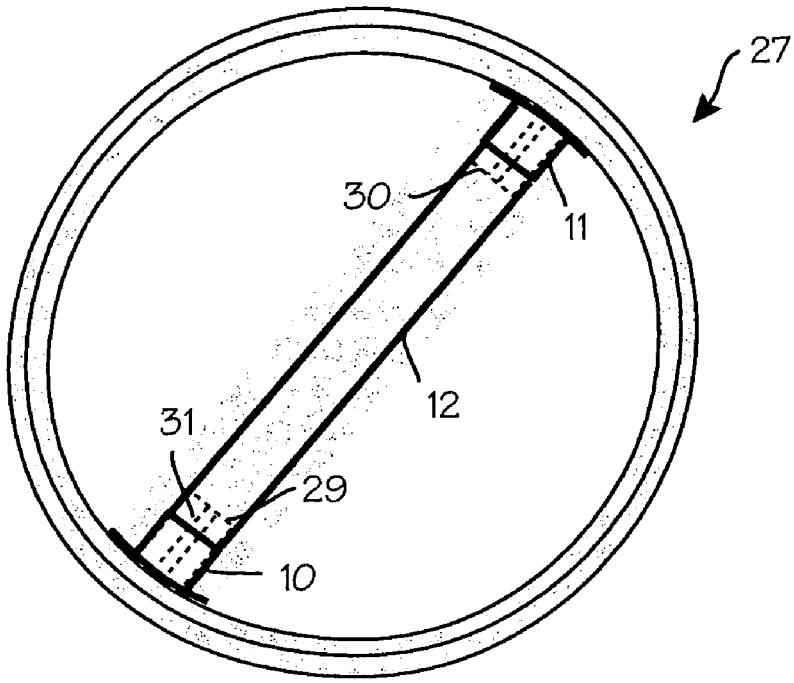
FIG. 4 illustrates a first section of a rotational mold.
Figure 5:
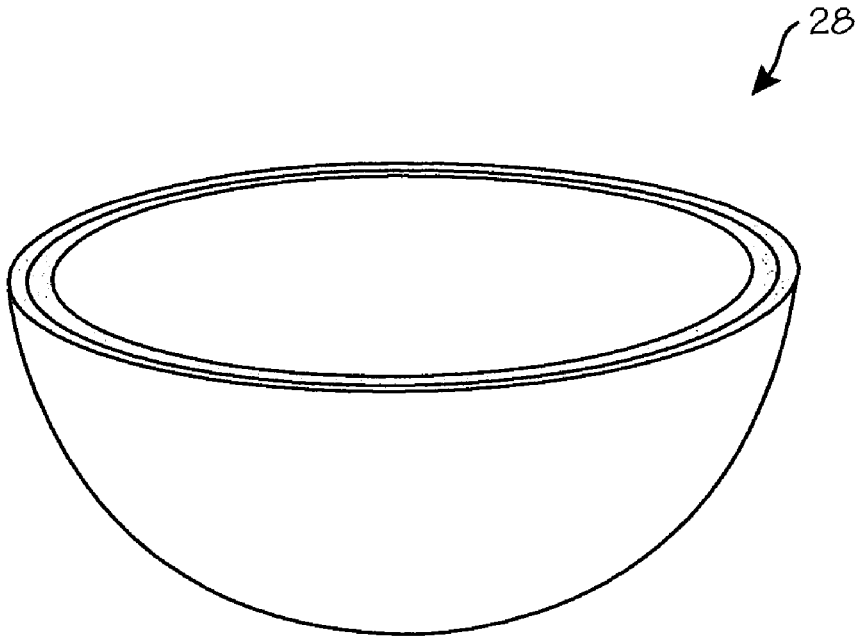
FIG. 5 illustrates a second section of a rotational mold.

FIGS. 4 and 5 illustrate a first section 27 and a second section 28 of the rotational mold used to manufacture the shell. The first section is provided with a first cylindrical heat sink 29 and a second cylindrical heat sink 30 for placement of flange fittings 10 and 11 and removal of heat from the first opening 8 and second openings 9. A bore 31 may be disposed within heat sinks 29 and 30 and the size of the bore 31 may vary to affect heating and cooling rates. The type and amount of material used in the heat sinks will affect rates of conduction from the core of the mold. Proper heat removal from the core and near openings 8 and 9 is necessary to achieve adequate shell thickness near openings 8 and 9 and to prevent defects in the shell that could eventually lead to shell failure. During manufacturing, flange fittings 10 and 11 are disposed about the heat sinks and the tube 12 is disposed between the fittings. The first section and second section are then coupled together. Plastic material is placed within the warm mold. The mold is then heated while being rotated. The rotation followed by the heating forces the plastic onto the inner surfaces of the mold and the flanges where the plastic material then melts and takes the shape of the mold and overmolds the flange fittings 10 and 11.

Figure 6:
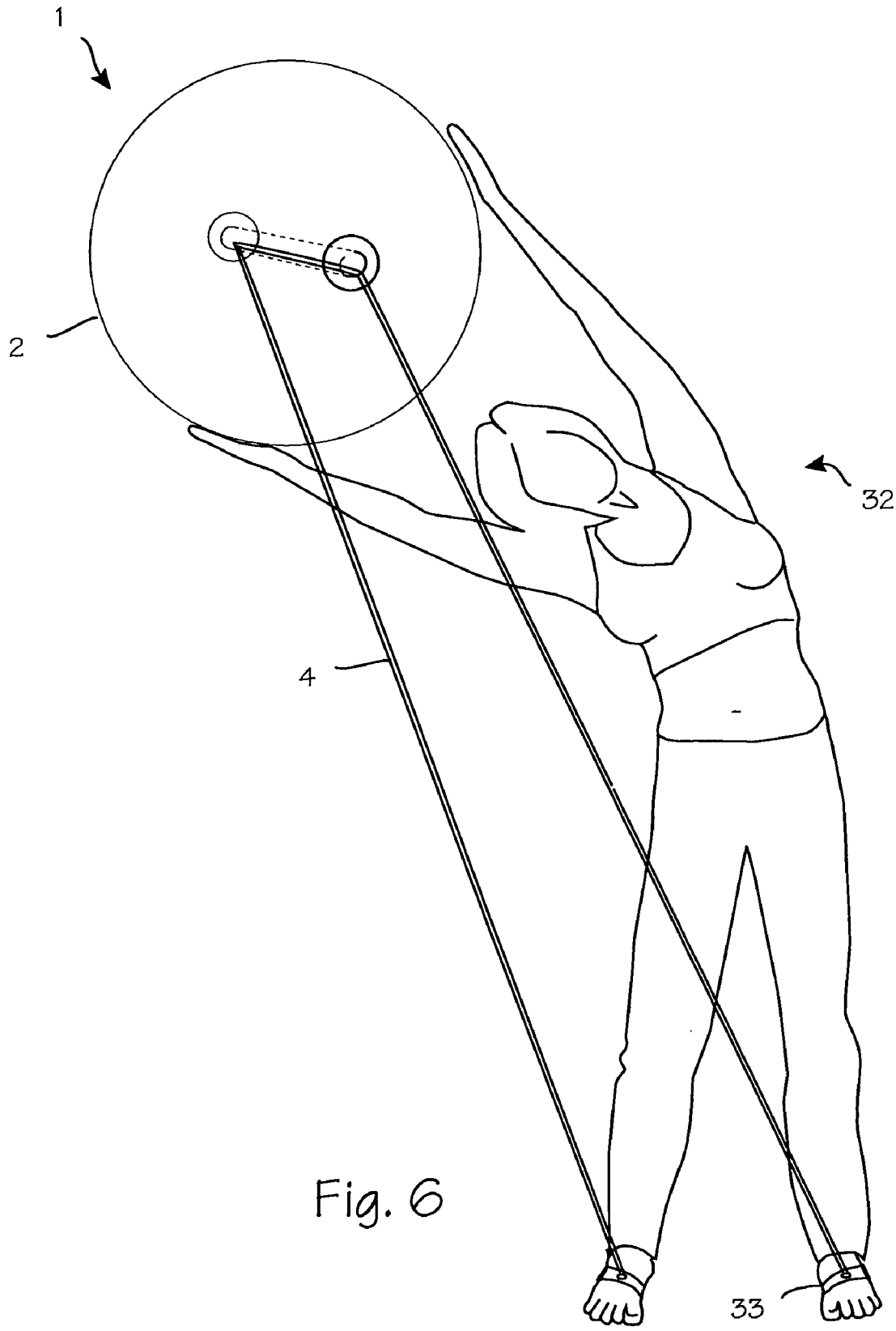
FIG. 6 illustrates the exercise system in use.

FIG. 6 illustrates the exercise system 1 in use. Here a user 32 is utilizing the inflatable exercise ball 2 with a resistance apparatus 4 having a looped handle 33. The user 32 places a left foot and a right foot through the handles and lifts the inflatable exercise ball 2 above her head. The resistance apparatus 4 is placed in tension while the user 32 moves the exercise ball from the left side to the right side.

Figure 7:
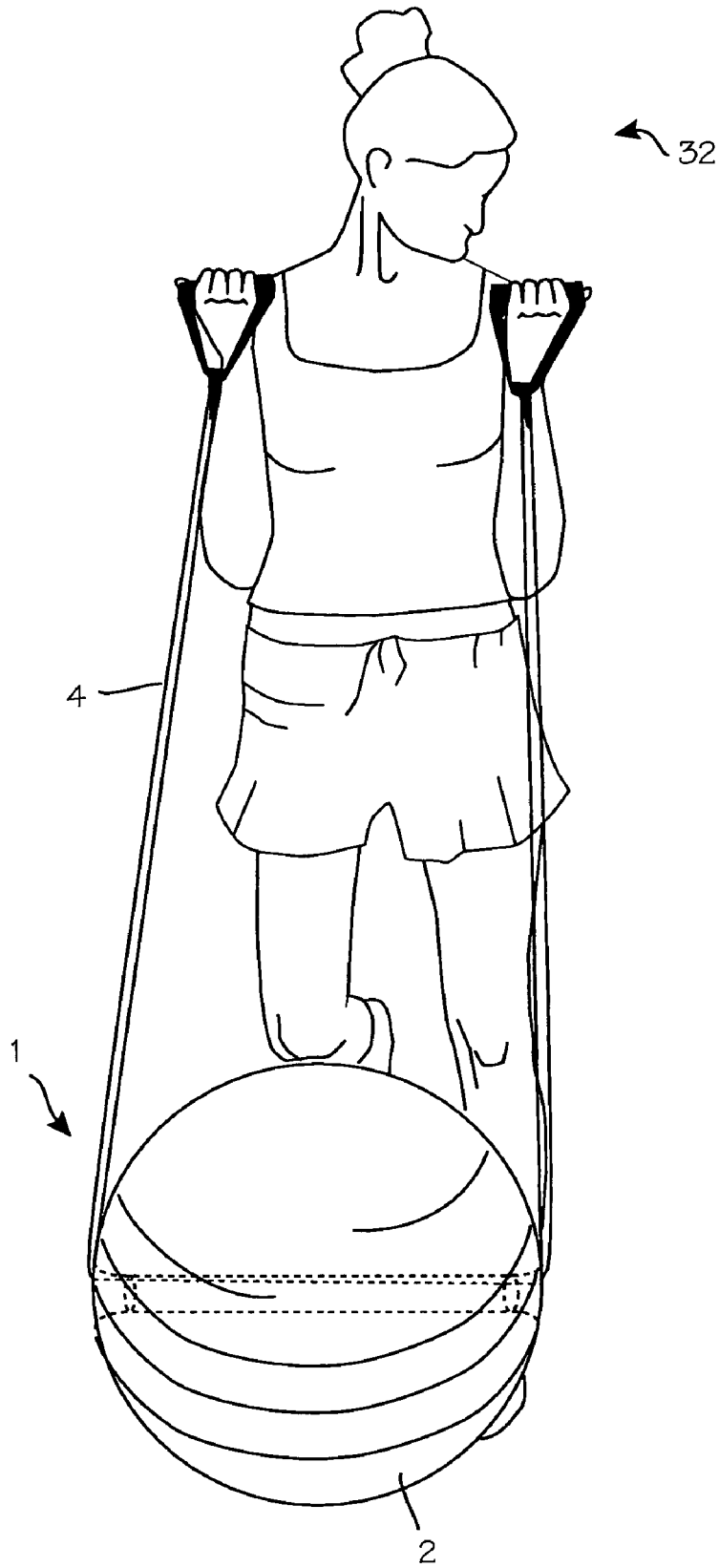
FIG. 7 illustrates a user performing an exercise using the exercise system with a resistance apparatus having a two handles.
Figure 8:
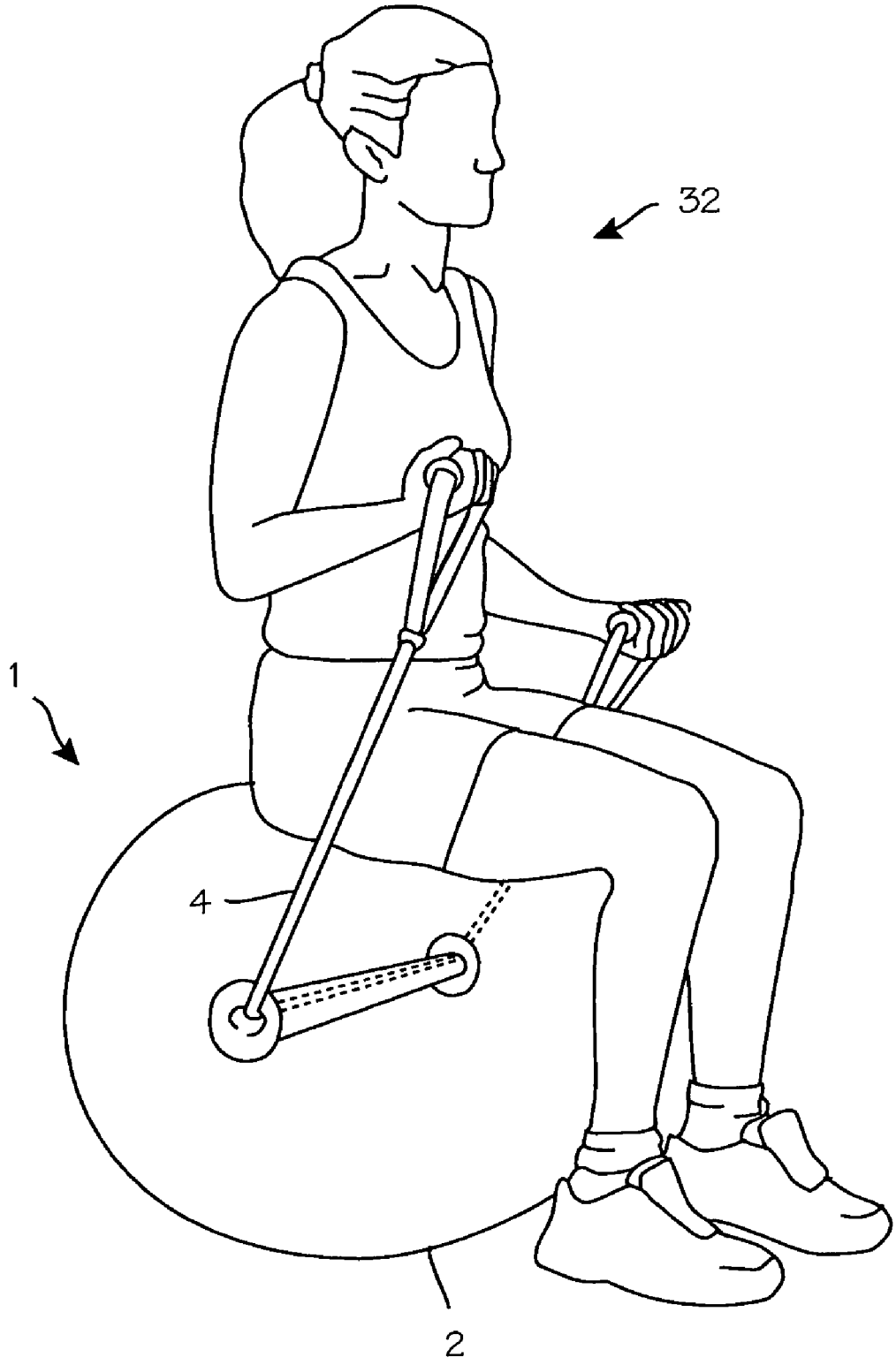
FIG. 8 illustrates a user sitting on the exercise system while performing arm curls with the resistance apparatus.

Another exercise being performed using the exercise system 1 is illustrated in FIG. 7. A user 32 is performing an exercise using the inflatable exercise ball 2 with a resistance apparatus 4 having a two handles. The user 32 is kneeling on the inflatable exercise ball 2 while performing arm curls with the resistance apparatus 4. In FIG. 8, a user 32 is sitting on the inflatable exercise ball 2 while performing arm curls with the resistance apparatus 4.

Figure 9:
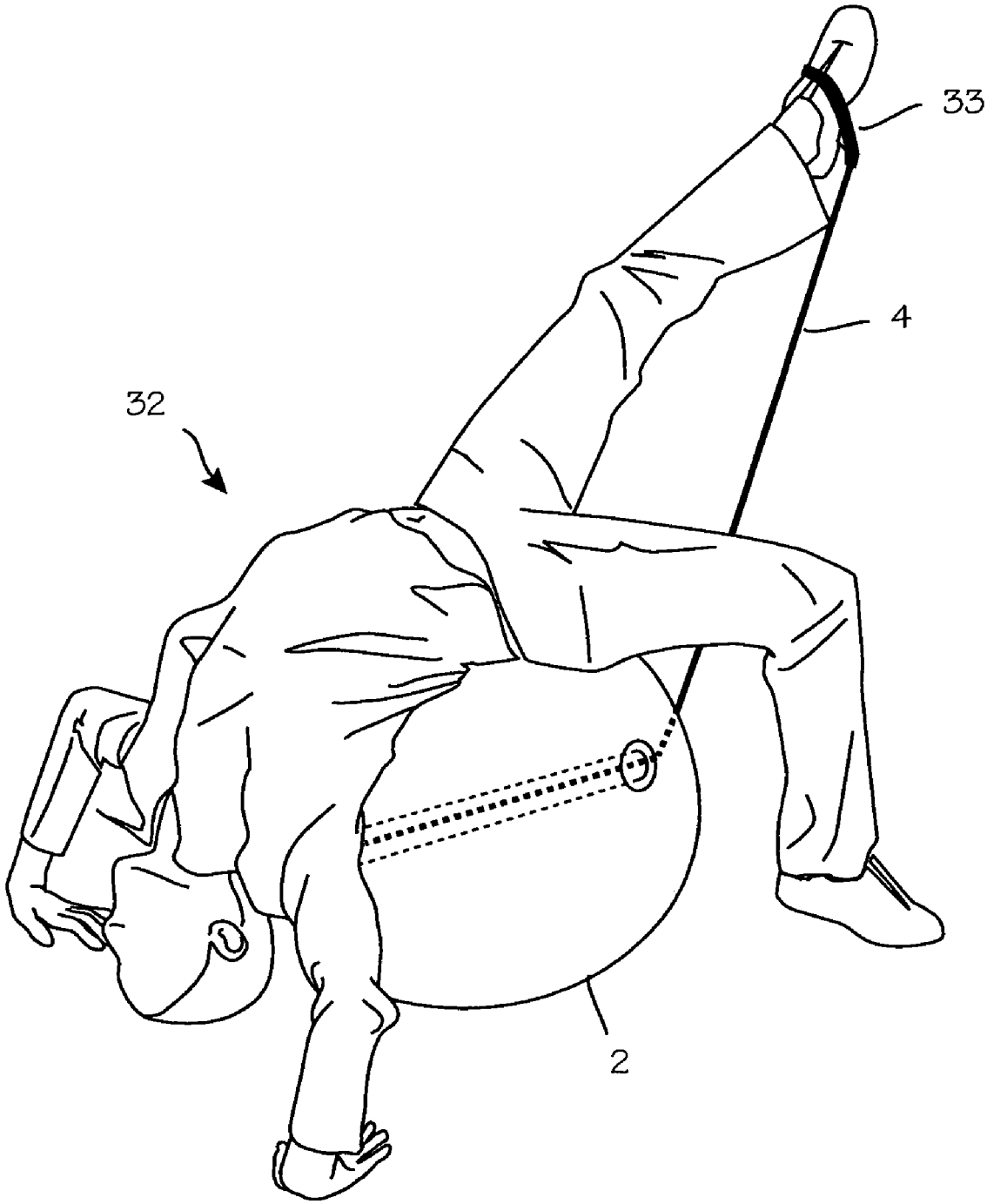
FIG. 9 illustrates a user lying down on the exercise system and performing leg lifts with the resistance apparatus.

FIG. 9 further illustrates the exercise system in use 1. A user 32 is performing an exercise using the inflatable exercise ball 2 with a resistance apparatus 4 having a plug and a looped handle 33. The user 32 is lying down on the inflatable exercise ball while placing her foot through the looped handle 33. The user is then able to perform leg lifts with the resistance apparatus 4.

While the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. An exercise system comprising:

an inflatable exercise ball having a polymeric shell and a bore comprising a flexible pipe extending therethrough wherein the bore further comprises a first flange fitting, a second flange fitting, and a tube of resilient material; and a resistance apparatus disposed at least partially within the bore.

2. The exercise system of claim 1 wherein the inflatable exercise ball further comprises a grip pattern disposed on an outer surface of the polymeric shell.

3. The exercise system of claim 1 wherein the resistance apparatus comprises an elastomeric tube.

4. The exercise system of claim 3 wherein the resistance apparatus further comprises a handle.

5. The exercise system of claim 3 wherein the resistance apparatus further comprises a plug.

6. The exercise system of claim 1 wherein the ball is about 30 cm to about 110 cm in diameter when inflated.

7. An inflatable exercise ball comprising:

an inflatable elastomeric shell having a first opening and a second opening;

a tube of resilient material extending between the first opening and the second opening; and a first flange between the first opening and the tube and a second flange between the second opening and the tube.

8. The exercise ball of claim 7 further comprising a grip pattern disposed on an outer surface of the elastomeric shell.

9. The exercise ball of claim 7 wherein the ball is about 30 cm to about 110 cm in diameter when inflated.

10. The exercise system of claim 5 wherein the plug is sized and shaped to prevent the elastomeric tubing from being completely pulled through the bore.

11. The exercse system of claim 10 wherein the plug is a polymeric ring disposed on one end of the tube of resilient material.

12. The exercise systemt of claim 10 wherein the plug is a hook disposed on one end of the tube of resilient material.

* * * * *